United States Patent [19]

Swanson et al.

[11] 4,348,783

[45] Sep. 14, 1982

[54] SCRUBBING MACHINE WITH SELECTIVE RECYCLE

[75] Inventors: Albert S. Swanson, Robbinsdale; Robert A. Geyer, Dayton, both of Minn.

[73] Assignee: Tennant Company, Minneapolis, Minn.

[21] Appl. No.: 205,294

[22] Filed: Nov. 10, 1980

[51] Int. Cl.[3] ..... A47L 11/30

[52] U.S. Cl. ..... 15/320; 15/353

[58] Field of Search ..... 15/302, 320, 321, 353

[56] References Cited

U.S. PATENT DOCUMENTS

| | | | |
|---|---|---|---|
| Re. 27,792 | 10/1973 | Howerin et al. | 15/321 |
| 1,711,380 | 4/1929 | Giampolini . | |
| 1,736,446 | 11/1929 | Keefer . | |
| 1,892,347 | 12/1932 | Jerome . | |
| 2,003,215 | 5/1935 | Nadig . | |
| 2,223,963 | 12/1940 | Nadig . | |
| 3,079,285 | 2/1963 | Rockwell . | |
| 3,346,122 | 10/1967 | Cornelissen . | |
| 3,431,582 | 3/1969 | Grave | 15/321 |
| 3,447,188 | 6/1969 | Maasberg . | |
| 3,447,545 | 6/1969 | Lawter . | |
| 3,543,321 | 12/1970 | Raia . | |
| 3,552,554 | 1/1971 | Olgard . | |
| 3,741,401 | 6/1973 | Hsiung . | |
| 3,754,656 | 8/1973 | Horiguchi et al. | |
| 3,833,961 | 9/1974 | Fortman et al. | |
| 3,848,804 | 11/1974 | Prestwich . | |
| 3,877,902 | 4/1975 | Eriksson et al. | |
| 3,942,214 | 3/1976 | Maasberg . | |
| 3,976,501 | 8/1976 | Blue . | |
| 3,996,640 | 12/1976 | Blue et al. | 15/320 |
| 4,134,174 | 1/1979 | Flynn et al. | 15/302 |
| 4,199,837 | 4/1980 | Fisco | 15/302 |
| 4,207,647 | 6/1980 | Masters | 15/302 |

OTHER PUBLICATIONS

Neptune Microfloc.
Permutit Technical Bulletin, vol. 9, No. 2 (2/71).
Wetrok.

*Primary Examiner*—Chris K. Moore
*Attorney, Agent, or Firm*—Norman P. Friederichs

[57] ABSTRACT

A scrubbing machine is described which may be operated either in a single cycle scrubbing mode or in a recirculating scrubbing mode. The scrubbing machine includes a body structure which is supported on a plurality of wheels. The scrubber has a pair of tanks one of which is a collector tank and the other of which is a solution feeding tank. A conduit and a pump are provided for moving the solution from the collector tank to the feeding tank. The collector tank may include a filter structure including a flexible conduit and a filtering element.

14 Claims, 2 Drawing Figures

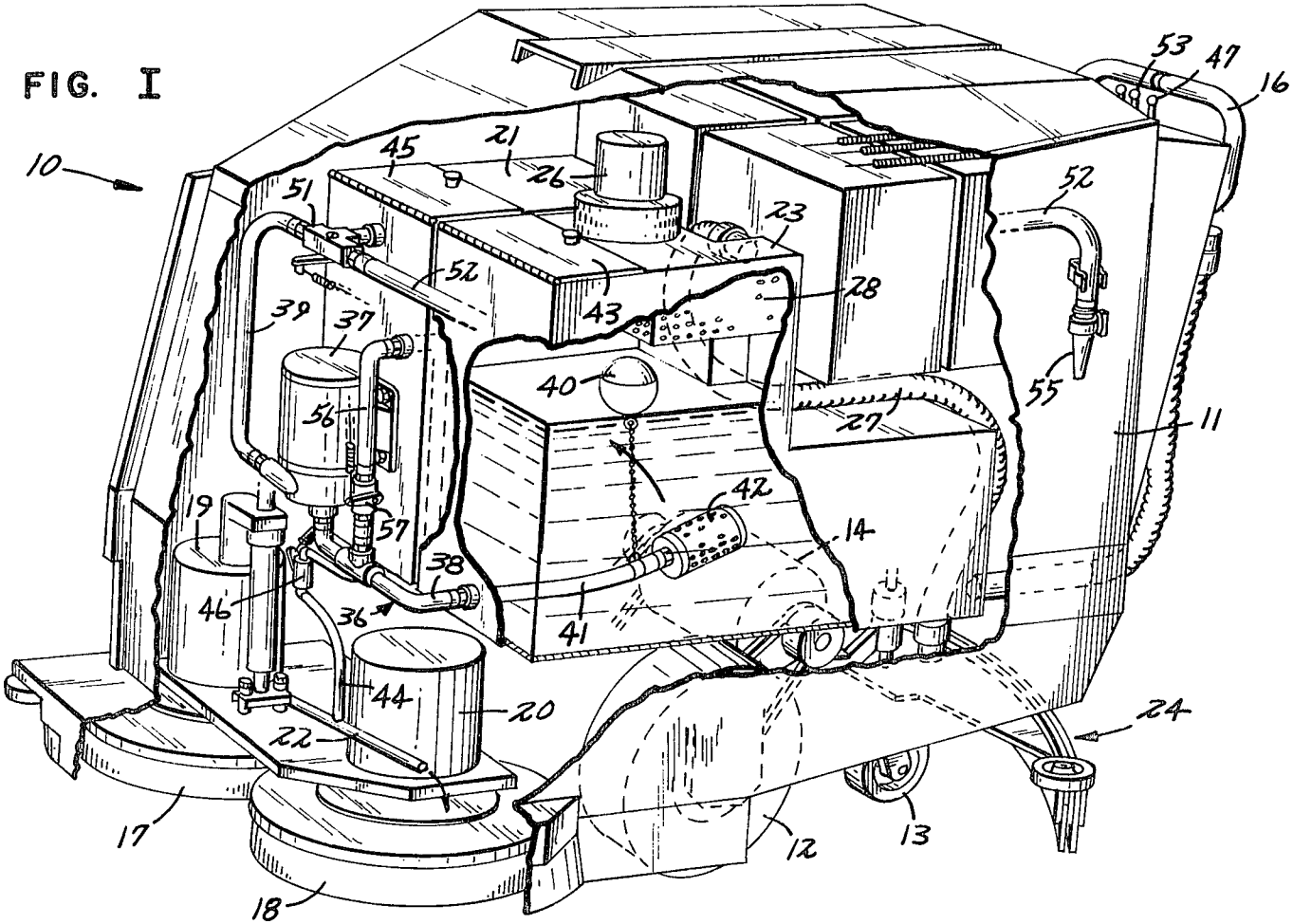
FIG. I

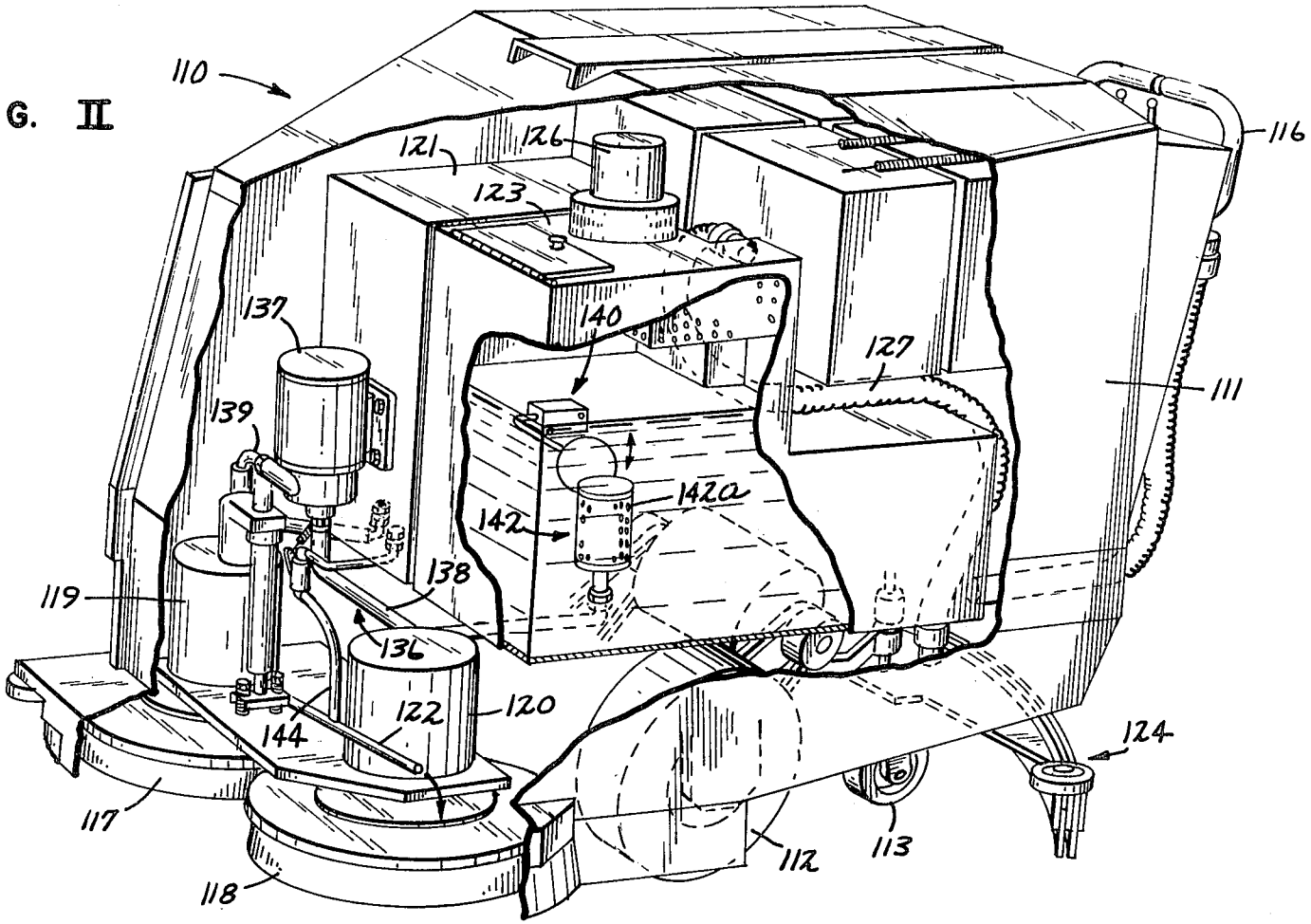
FIG. II

SCRUBBING MACHINE WITH SELECTIVE RECYCLE

BACKGROUND OF THE INVENTION

The present invention relates to floor maintenance equipment and more particularly to floor maintenance equipment commonly identified as scrubbing machines.

Many improvements in scrubbing machines have been made over the years. Not too many years ago, scrubbing of industrial floors was carried out by hand, utilizing rope-like mops to apply scrub water to floors. Mops were used to agitate the scrub water until dirt and grime were loosened and removed. The scrub water was then picked up again using the mop and redeposited in a scrub bucket.

Automated scrubbing machines were later developed in which water was automatically deposited on the floor surface, agitated by rotating brushes to loosen the diret and soilage and then picked up utilizing a vacuum squeegee. At first, scrubbing solution was merely deposited on the floor, worked and picked up with only a single usage of the scrubbing solution. Subsequently, it was found that a certain amount of recirculation of the scrubbing solution could be made thus extending the surface area which could be scrubbed utilizing a single tank of scrubbing solution. Many important refinements have been made since that time. For example, systems are now provided in which chemicals remove suspended matter from the scrubbing solution during recirculation thereby further extending the running time.

SUMMARY OF THE PRESENT INVENTION

The present invention provides a scrubbing machine which is simple in construction, inexpensive in manufacture and yet highly versatile in use. The scrubbing machine has an extended running time. The present scrubber has a body structure which is supported on a plurality of wheels. The body structure carries a power unit which may be electrically driven or operated by a gasoline or diesel engine. The body structure may also carry a disc-like cylindrical brush for agitating a scrubbing solution on a floor surface. The power unit in addition may rotatably drive the brush. Alternatively, a separate power source may be used to drive the brush or brushes.

The present scrubbing machine includes a vacuum system with a squeegee for picking up scrubbing solution. The present scrubber has a pair of tanks, one of which is a solution feeding tank and may contain a scrubbing solution for deposition on the floor surface such as through a plurality of nozzles. The other tank serves to contain the scrubbing solution which is picked up by the vacuum squeegee. Conduits are provided interconnecting the two tanks. A pump cooperates with the conduits to selectively move the solution from the collecting tank to the feeding tank.

The present scrubbing machine may serve as a single cycle scrubber, where the scrubbing solution is used only once and then discarded. In this mode of operation, the pump is utilized only to empty the collector tank into a discharge hose which in turn may feed spent scrubbing solution to a drain receptacle. This mode of operation is particularly advantageous for use in scrubbing small areas where recirculation is not needed, as well as for usage in those situations where the floor surface contains a high level of soilage.

The present scrubbing machine may be changed to a second mode of operation in which the scrubbing solution is recycled by pumping the used scrubbing solution from the collector tank back to the feeder tank and the solution again passes through the scrubbing cycle. If desired, operation may be commenced with both of the tanks at least partially filled with clean scrubbing solution. In this mode, the pump may also be used to pump out the tanks at the time of discarding the spent scrubbing solution.

The conduits may include a flexible pipe and filter portion which extends into the collector tank. A filter may be provided at the end of the flexible pipe for removing solid particles from the scrubbing solution when operating in the recycle mode. A float device may be provided to hold the filter element supported above the bottom of the collector tank. This increases the life of the filter element since the filter element is above the solid matter which has settled out of the scrubbing solution.

In another embodiment the filter element may be mounted to a fitting in the bottom of the tank with the axis of the cylindrical filter being disposed vertically. In this embodiment the pump may include a float switch to assure that the filter remains covered with solution at all times during operation. The vertical disposition of the filter increases operating time since the sloshing of the water tends to rinse solid matter from the filter thereby preventing blinding.

IN THE DRAWINGS

FIG. I is a perspective view of a scrubbing machine embodying the present invention; and FIG. II is a perspective view of another embodiment of the present invention.

DETAILED DESCRIPTION OF THE PRESENT INVENTION

The scrubbing machine of the present invention may be a walk behind scrubber 10 as illustrated in FIG. I or alternatively may be a riding scrubber. The scrubber 10 includes a body 11 which is supported on a plurality of wheels such as 12 and 13. At least one of the wheels such as 12 is driven by a motor 14. The other wheel or wheels such as 13 may be pivotable so as to assist in steering of the scrubber 10. A steering mechanism 16 in the form of a bar may be provided to assist in controlling the direction traversed by the scrubber 10. Brushes 17 and 18, which are driven by motors 19 and 20 respectively, serve to work a scrubbing solution on the floor surface to loosen soilage.

The scrubber 10 has a pair of tanks including first tank 21 which serves to feed a scrubbing solution through a plurality of nozzles 22 to the floor surface. The scrubbing machine 10 has a second tank 23 which serves as a collector for the scrubbing solution picked up by squeegee 24. The squeegee 24 may be of conventional construction and may be vacuum operated by a fan 26. In other words, vacuum fan 26 applies a vacuum to collector tank 23 which in turn draws a vacuum on the conduit 27 extending to squeegee 24. The conduit 27 may feed into a strainer basket 28 which serve to catch any large debris pieces such as cigarette butts, twigs, small stones and the like picked up by the squeegee 24.

The scrubber 10 is provided with a conduit system 36 including a water pump 37 which is connected to tank 23 by tubing 38 and to tank 21 by tubing 39. The tubing 38 may have a flexible extension 41 which extends into tank 23. The flexible extension 41, for example, may be of rubber or plastic hose and has a filter element 42 attached at one end. A float 40 may be provided to hold filter element 42 supported above the bottom of tank 23.

Tank 23 has a hinged door 43 which provides access to the interior of tank 23. Thus, one may raise the door 43, reach into the scrubbing solution and lift the filter element 42 and flexible hose 41 upwardly to change the filter element 42. A suitable seal must be provided around the door 43 when in the lowered position thereby permitting development of a vacuum within tank 23 during the scrubbing operation. Tank 21 may likewise include a hinged door 45 providing access to enable cleaning of tank 21.

A conduit 44 extends from the tank 21 to the nozzles 22. The conduit 44 may include a variable valve 46 which may be adjusted by control lever 47 to apply the scrubbing solution to the floor surface at the desired rate. At this point the scrubbing solution may be moved by gravity flow. A control valve 51 is provided in conduit 39 whic may direct the scrubbing solution into tank 21 or alternatively direct the scrubbing solution into a discharge hose 52. The control valve 51 may be operated by control lever 53 to a selected one of three modes; namely, a closed position where no solution is permitted to flow out of tank 23, an open position where solution flows from tank 23 to tank 21 and an open position where solution flows from tank 23 to the discharge hose 52. The flow in each instance is produced by pump 37 which likewise may be placed in operation by control lever 53. The hose 52 may be of sufficient length to permit discharge in a floor drain or sink. The hose 52 may have a nozzle 55 for auxiliary cleaning of surfaces. For example, the hose and nozzle may be used on hard-to clean areas such as corners. Tank 21 may include a conduit 56 with valve 57 which interconnects tank 21 with pump 37. Conduit 56 serves to drain tank 21 through pump 37 and tube 52 when valve 57 is in the open position. The pump 37 may be used for emptying both tank 21 and 23.

OPERATION OF THE INVENTION

Although operation of scrubbing machine 10 is apparent from the preceding description, it will be further set forth in detail herein in order to provide an even more complete understanding of the present invention.

The scrubbing machine 10 may be placed in operation in a conventional manner by switching on the motor 14 which drives wheel 12. The vacuum 26 is activated by a suitable switch. The operator appropriately steers the scrubbing vehicle to the desired location for scrubbing and then moves the control 47 to a position where valve 46 permits scrubbing solution to pass by gravity flow through conduit 44 to nozzle 22 thereby depositing scrubbing solution on the floor surface. The motors 19 and 20 operate the scrubbing brushes 17 and 18 which agitate the scrubbing solution on the floor surface. As the scrubbing machine 10 is moved along the floor surface, squeegee 24 picks up solution by the vacuum produced by pump 26. The solution in turn is deposited in tank 23 which is the collector tank for storage of scrubbing solution. Vacuum pump 26 applies a vacuum force to tank 23 thereby drawing the scrubbing solution from squeegee 24 up through conduit 27.

The scrubbing solution, upon entering tank 23, passes through the wire basket 28 to remove pieces of debris such as cigarette butts, twigs and the like. The present scrubbing machine may be operated as a single cycle scrubber by closing valve 51 and not operating the scrubbing solution pump 37 during the scrubbing operation. Once the scrubbing operation is completed, pump 37 may be used to evacuate scrubbing solution through conduit 39, valve 51 in the third position and discharge tube 52.

If one desires to operate the present scrubber in the recirculating mode, operation is somewhat similar, however, during the scrubbing operation, pump 37 moves the scrubbing solution through conduits 38 and 39, valve 51 in the second position and into tank 21 where the scrubbing solution then again moves through tube 44 to the scrubbing nozzles 22 and the cycle is continuously repeated. The scrubbing solution is of course filtered as it moves through filter element 42. The filter 42, for example, may have openings of 1/32 inch or smaller to remove the medium size particulate matter. The filter element 42 may be supported above the bottom of tank 23 thereby staying above any soilage that may settle out of the solution. The filter element 42 may be changed by pulling upwardly on tubing 41 to lift element 42 out of the solution. The element 42 may be threadedly removed and a new filter element mounted.

DESCRIPTION OF ALTERNATIVE EMBODIMENT

A preferred alternative embodiment of the present invention is shown in FIG. II. The scrubber embodiment 110 is illustrated as a walk-behind unit. The scrubber 110 has a body structure 111 supported on a plurality of wheels 112 and 113. The wheels may be suitably driven. The scrubber 110 may be similar in general construction to that of scrubber 10 shown in FIG. I. The scrubber 110 may have a plurality of scrubbing brushes 117, 118 which are driven by motors 119 and 120. Scrubber 110 has a pair of tanks 121 and 123. Scrubbing solution is fed from tank 121 through a plurality of nozzles 122 to the floor surface. The scrubbing machine 10 has a squeegee unit 124 for picking up scrubbing solution from the floor and redepositing that solution in tank 123. The squeegee unit 124 includes a vacuum pump 126 which draws a vacuum on tank 123 thereby drawing scrubbing solution upwardly through conduit 127 with such solution being deposited in tank 123.

The scrubber 110 has a conduit system 136 including a water pump 137 which is connected to tank 123 by tubing 138. The water pump 137 is connected to a conduit 139 which extends to tank 121. A filter 142 is attached to conduit 138 interiorly of tank 123. The filter unit 142 has a vertically oriented cylindrical filter element 142*a* which is supported in an elevated position within the tank 123. The tank 123 may have a removable cover which permits access to the interior of tank 123 for cleaning purposes. The scrubbing machine 110 may have a float switch 140 which assures that the level of solution in tank 123 is maintained at least as high as the upper end of the filter elment 142*a*, thus preventing drawing of air through the pump 137.

A conduit 144 may extend from tank 121 to the nozzles 122 for feeding solution from tank 121 to the nozzles 122.

The scrubbing unit 110 may be provided with suitable controls for turning the pump 137 on and off. Thus, if the pump 137 is in an operating mode, solution will be moved from tank 123 to tank 121, thereby providing for recirculation of the scrubbing solution during the scrubbing operation. Alternatively, the pump 137 may be in an off mode and the scrubbing unit 110 will operate as a single cycle or nonrecirculating unit. Of course, various other controls may be provided for placing the vacuum pump 126 in an operating mode as well as controlling the power provided to the driving wheels 112.

Although preferred embodiments of the present invention have been described in detail herein, various modifications may be made without departing from the broader scope of the present invention. For example, the scrubbing unit may be a riding model.

What is claimed:

1. A scrubbing machine comprising:

body means supported on a plurality of wheels;

power means for rotatably driving at least one of said wheels;

a pair of tanks adapted to contain scrubbing solution;

means associated with one of said tanks for applying scrubbing solution from said one tank to a surface to be scrubbed;

means for working said solution on said surface;

means associated with the other of said tanks for picking up said solution from said surface to said other tank, said pick up means including a vacuum squeegee and pump means for lifting said solution from said squeegee to said other tank;

selective means, said selective means being adapted to selectively retain said solution in said other tank during scrubbing thereby providing single cycle scrubbing, said selective means being adapted to selectively pump said solution from said other tank to said one tank thereby providing recycle scrubbing, said selective means further being adapted to selectively pump said solution from said other tank to a discharge thereby providing rapid discharge of used scrubbing solution.

2. The scrubbing machine of claim 1 wherein said basket filter means is removable from said other tank.

3. The scrubbing machine of claim 2 wherein said selective means further include filter means for removing particulate matter from said solution as said solution is moved from said other tank to said one tank.

4. The scrubbing machine of claim 3 wherein said filter means comprise a vertically disposed tubular filter element, said filter element being located in the lower portion of said other tank.

5. The scrubbing machine of claim 4 wherein said machine has a float switch to assure a solution level at least as high as the upper end of said filter.

6. A scrubbing machine comprising body structure supported on a plurality of wheels, power means for driving at least one of said wheels, first and second scrubbing solution tanks carried by said body structure, conduit means providing fluid communication between said first tank and said second tank, pump means associated with said conduit means for selectively moving scrubbing solution from said second tank through said conduit to said first tank, said pump means providing for selecting between single cycle scrubbing and recycle scrubbing, basket filter means associated with said second tank to remove debris from said solution, means for moving scrubbing solution from said first tank to a surface, means for agitating said scrubbing solution on said surface, and squeegee means and second pump means for lifting said scrubbing solution from said surface to said second tank.

7. The scrubbing machine of claim 6 wherein said basket means comprises a strainer basket for removing larger pieces of debris from said scrubbing solution as said solution enters said second tank.

8. The scrubbing machine of claim 7 wherein said machine includes a tubular filter, said filter being disposed with a vertical axis.

9. The scrubbing machine of claim 7 wherein said second tank includes a flexible outlet conduit which lies within said second tank, said outlet conduit having a filter disposed at one end to remove particulate matter from said solution as said solution is moved from said second tank to said first tank.

10. A scrubbing machine comprising body structure supported on a plurality of wheels, first and second scrubbing solution tanks carried by said body structure, conduit means providing fluid communication between said first tank and said second tank, pump means associated with said conduit means for selectively moving scrubbing solution from said second tank through said conduit to said first tank, a flexible outlet pipe disposed in said first tank means and in association with said communication conduit, a filter element engaged with the free end of said flexible outlet pipe to remove particulate matter from said solution as the solution is drawn from said second tank, means for moving scrubbing solution from said first tank to a surface, means for agitating said scrubbing solution on said surface, and squeegee means for lifting said scrubbing solution from said surface to said second tank.

11. A scrubbing machine comprising:

body means supported on a plurality of wheels;

power means for rotatably driving at least one of said wheels;

a pair of tanks adapted to contain scrubbing solution;

means associated with one of said tanks for applying scrubbing solution from said one tank to a surface to be scrubbed;

means for working said solution on said surface;

means associated with the other of said tanks for picking up said solution from said surface to said other tank;

means for selectively moving said solution from said other tank to said one tank thereby selectively recycling said solution or retaining said solution in said other tank to provide single cycle scrubbing; and said selective means including filter means for removing particulate matter from said solution as said solution is moved from said other tank to said one tank, said filter means including a filter element and a flexible outlet conduit disposed in said other tank, said filter element being disposed at one end of the flexible outlet conduit, said filter means further including float means for positioning said filter element in said other tank.

12. A scrubbing machine comprising body structure supported on a plurality of wheels, power means for driving at least one of said wheels, first and second scrubbing solution tanks carried by said body structure, conduit means providing fluid communication between said first tank and said second tank, pump means associated with said conduit means for selectively moving scrubbing solution from said second tank through said conduit to said first tank, basket filter means associated with said second tank to remove debris from said solution, means for moving scrubbing solution from said first tank to a surface, means for agitating said scrubbing solution on said surface, squeegee means for lifting said scrubbing solution from said surface to said second tank, and a discharge hose associated with said pump means for auxiliary cleaning.

13. A scrubbing machine comprising body structure supported on a plurality of wheels, first and second scrubbing solution tanks carried by said body structure, conduit means providing fluid communication between said first tank and said second tank, pump means associated with said conduit means for selectively moving scrubbing solution from said second tank through said conduit to said first tank, a flexible outlet pipe disposed in said first tank means and in association with said communication conduit, a filter element engaged with the free end of said flexible outlet pipe to remove particulate matter from said solution as the solution is drawn from said second tank, means for moving scrubbing solution from said first tankto a surface, means for agitating said scrubbing solution on said surface, squeegee means for lifting said scrubbing solution from said surface to said second tank, said machine further including a flexible discharge hose and nozzle associated with said pump means, said discharge hose and nozzle being adapted for auxiliary cleaning of surfaces.

14. A scrubbing machine comprising:

body means supported on a plurality of wheels;

power means for rotatably driving at least one of said wheels;

a pair of tanks adapted to contain scrubbing solution;

means associated with one of said tanks for applying scrubbing solution from said one tank to a surface to be scrubbed;

means for working said solution on said surface;

means for picking up said solution from said surface for deposit in said other tank;

said pickup means including a vacuum squeegee and a first pump, said pump being disposed between said vacuum squeegee and said other tank and serving to lift said solution from said squeegee to said other tank, said other tank being at ambient pressure during operation and including an access opening therein; and selective means, said selective means including a second pump and control mechanism, said selective means being adapted to selectively retain said solution in said other tank during scrubbing thereby providing single cycle scrubbing and said selective means being adapted to selectively pump said solution from said other tank to said one tank thereby providing recycle scrubbing.

* * * * *

UNITED STATES PATENT AND TRADEMARK OFFICE

CERTIFICATE OF CORRECTION

PATENT NO. : 4,348,783

DATED : September 14, 1982

INVENTOR(S) : Albert S. Swanson et al

It is certified that error appears in the above—identified patent and that said Letters Patent is hereby corrected as shown below:

Column 1, line 20, "diret" should be --dirt--;

Column 3, line 21, "whic" should be --which--;

Column 7, line 17, "tankto" should be --tank to--.

Signed and Sealed this

*Twenty-fifth* Day of *January 1983*

[SEAL]

*Attest:*

GERALD J. MOSSINGHOFF

*Attesting Officer*

*Commissioner of Patents and Trademarks*

Disclaimer 4,348,783.—*Albert S. Swanson,* Robbinsdale and *Robert A. Geyer,* Dayton, Minn. SCRUBBING MACHINE WITH SELECTIVE RECYCLE. Patent dated Sept. 14, 1984. Disclaimer filed Apr. 3, 1986, by the assignee, *Tennant Co.*

Hereby enters this disclaimer to claims 2 and 14 of said patent.

[*Official Gazette May 27, 1986.*]

UNITED STATES PATENT AND TRADEMARK OFFICE

CERTIFICATE OF CORRECTION

PATENT NO. : 4,348,783

DATED : September 14, 1982

INVENTOR(S) : Albert S. Swanson and Robert A. Geyer

It is certified that error appears in the above—identified patent and that said Letters Patent is hereby corrected as shown below:

In column 6, line 20, change "first" to --second--.
In column 7, line 11, change "first" to --second--.

Signed and Sealed this

*Tenth* Day of *June 1986*

[SEAL]

*Attest:*

DONALD J. QUIGG

*Attesting Officer*

*Commissioner of Patents and Trademarks*